United States Patent [19]

Horvath

[11] Patent Number: 4,955,573

[45] Date of Patent: Sep. 11, 1990

[54] WATER HEATER SAFETY FASTENER

[76] Inventor: George Horvath, 17608 Los Alimos, Granada Hills, Calif. 91344

[21] Appl. No.: 452,049

[22] Filed: Dec. 18, 1989

[51] Int. Cl.[5] ..... A47K 1/08

[52] U.S. Cl. ..... 248/313; 248/154

[58] Field of Search ..... 248/313, 146, 154, 311.2, 248/309.1, 312; 211/88; 52/67; 220/18

[56] References Cited

U.S. PATENT DOCUMENTS

| | | | |
|---|---|---|---|
| 991,192 | 5/1911 | Battenfeld | 248/154 VX |
| 1,427,375 | 8/1922 | Gove | 248/313 |
| 3,674,233 | 7/1972 | Van Buren | 248/499 X |
| 3,765,635 | 10/1973 | Burrell | 248/313 |
| 3,894,707 | 7/1975 | Heard | 248/231 |
| 4,125,240 | 11/1978 | Heard | 248/231 X |
| 4,132,336 | 1/1979 | Leinaar | 248/231 X |
| 4,309,263 | 1/1982 | Boyd | 248/231 X |

*Primary Examiner*—J. Franklin Foss

*Attorney, Agent, or Firm*—Sanford Astor

[57] ABSTRACT

The invention comprises a safety fastener or collar adapted to securely fasten a holding tank, such as a water heater of any size, to the walls of the structure surrounding the tank. The collar comprises two portions including a non-flexible, rigid supporting collar which is attached to the surrounding wall by a pair of rigid holding legs and a second flexible collar which is also securely fastened to the same supporting wall by use of a joint tie-strap.

15 Claims, 1 Drawing Sheet

FIG. 1
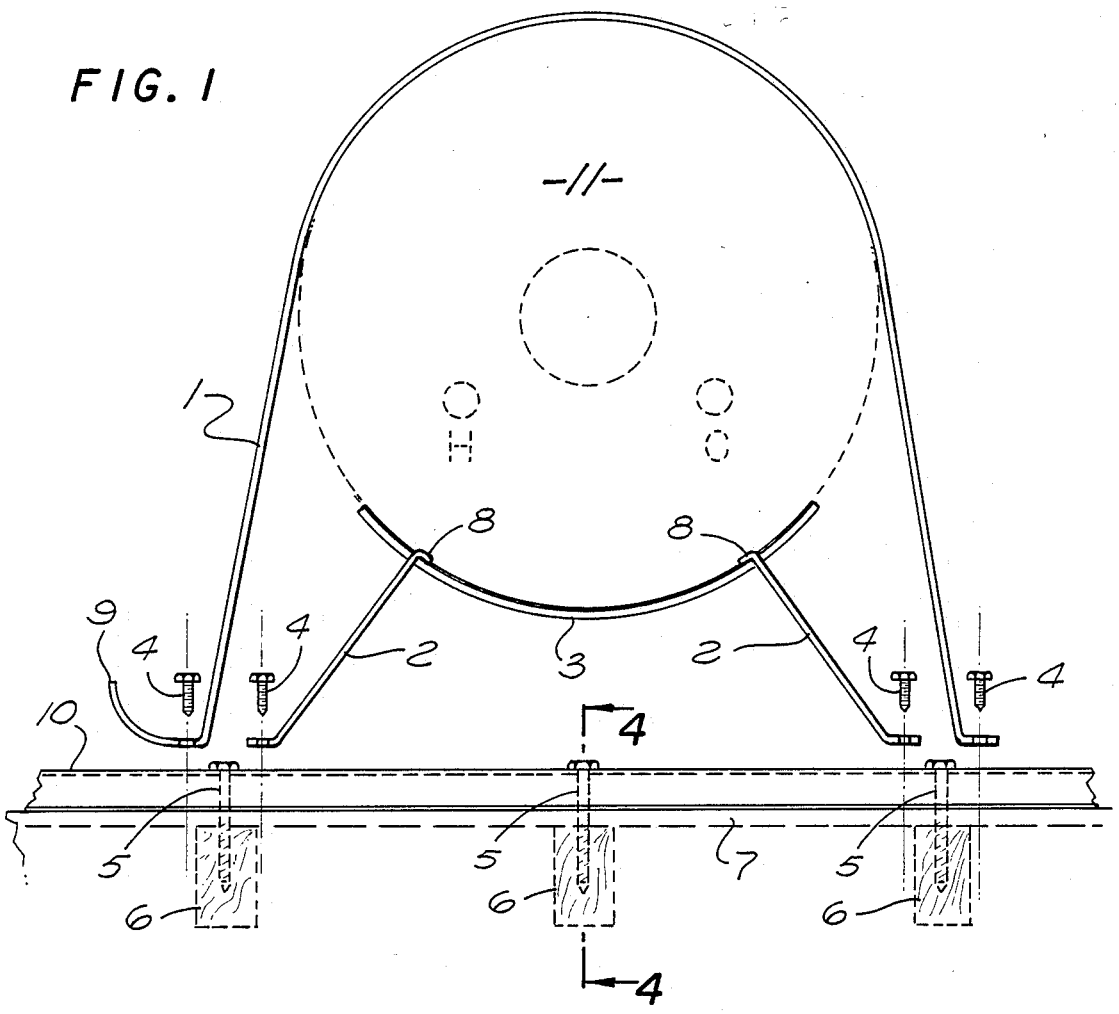
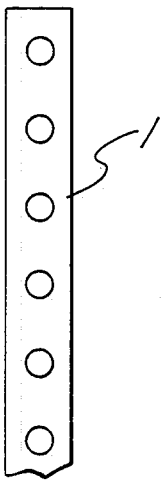
FIG. 2
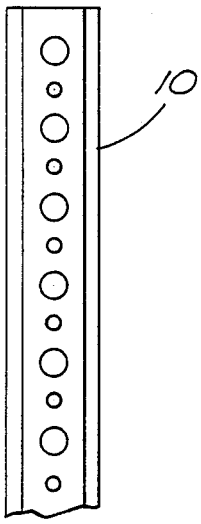
FIG. 3
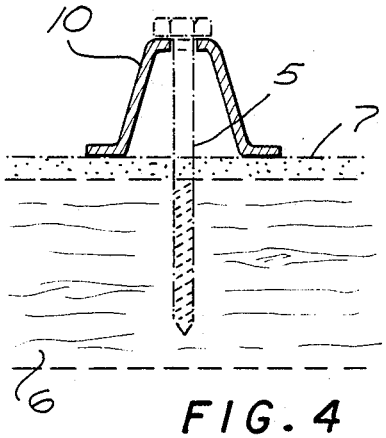
FIG. 4

WATER HEATER SAFETY FASTENER

BACKGROUND OF THE INVENTION

Most common household and even commercial water heaters are either not fastened to their enclosure or are fastened with simple straps that allow independent movement of the water heater in the structure. During an earthquake or other disaster the unfastened water heater can move and break water and gas or electric lines connected to it. If the water heater is loosely fastened, the fastener can easily snap as independent motion of the water heater in the structure exceeds the fasteners capability to hold.

Supporting collars, including those that are manufactured with two semi-circular elements have been known in the past, for the support of pipes or pipelines. These pipes often corrode and eventually break off. Such a collar is described in U.S. Pat. No. 4,754,941. These types of collars, however, are not satisfactory to securely fasten an existing water heater to the walls of the structure surrounding the water heater. This is normally due to the fact that the supporting collars as known are fastened to the wall in one or two locations only, and in addition, the supporting structure for a pipe or pipeline is not adequate for the support of a vertically standing hot water tank. Also, the studs in the wall are usually not properly positioned for the hardware.

OBJECTS OF THE INVENTION

It is an object of the present invention to provide a safety strap and collar system for existing household and commercial hot water heaters.

It is a further object of the invention to provide a safety strap or collar system which prevents the hot water heater from any horizontal movement in relation to its enclosure so that, during an earthquake or other disaster the water heater cannot move with respect to the wall and break water, gas or electric lines.

Yet a further object of the invention is to provide a safety strap or collar system which, while holding the water heater securely to the enclosure, also allows for proper ventilation on all sides and provides the distance from the wall required by building codes.

In addition, the safety strap system is adjustable, which allows installation of the safety strap system to existing water heaters, which are at varying distances from the wall, without disconnecting any water, gas or electric lines and in addition, the system will fit any common size water heater. The system also allows easy replacement of the water heater and the system is reusable again and again.

BRIEF DESCRIPTION OF THE DRAWINGS

These and further objects and advantages of the invention will be more specifically pointed out upon reference to the following specification, claims and drawings in which:

FIG. 1 is a top view in cross-section of the safety strap system of the invention;

FIG. 2 is a partial view of the outer supporting strap, and

FIG. 3 is a partial view of the joint-tie strap.

FIG. 4 is a cross-section taken on lines 4—4 of FIG. 1.

Referring now to the drawings there is shown the binding strap or outer collar 1, which comprises a flexible, metallic strip having a plurality of holes which is adapted to be wrapped around the outer circumference of the water heater 11.

A non-flexible, rigid supporting collar 3 supports the wallside surface of the water heater 11. Supporting strap 3 also contains a plurality of slots adapted to receive the swing-hinge hook 8 of a supporting leg 2. Supporting leg 2 is thus adjustable for distance between the wall and tank. Two such supporting legs 2 support the side of the water heater 11 which is closest to the enclosing wall 7. Supporting legs 2 are non-flexible, rigid, metallic strips which contain at one end a swing-hinge hook 8 and at the other end are adapted to be fixedly attached to wall 7 through a joint-tie strap 10 by self-tapping screws 4. The supporting legs 2, for the strongest support, are set at an angle to the wall 7, preferably at between 30 to 60 degrees, pointing to the center of the water heater. Rigid collar 3 must be manufactured to fit the circumference of the water heater 11.

The supporting action of the rigid support collar 3 prevents the water heater 11 from movement in the direction of the enclosing wall 7 and prevents rolling movement alongside said wall. The joint-tie strap 10 is a rigid, metal strip, having a plurality of holes, which is fixedly attached through the wall 7 and into wall studs 6 by lag bolts 5, or in the case of a concrete wall using lag screw shields. Thus, the joint-tie strap 10 is solidly fixed onto wall 7 by attachment with the lag bolts 5 directly into the wall studs 6 at multiple points preventing any possible movement of the joint-tie strap 10. Strap 10 has alternating large and small holes, the larger holes to accommodate the lag bolts 5 and the smaller holes to accommodate the screws 4.

While the supporting legs 2, as well as the binding strap 1 could be attached to the wall 7 directly, it is usually difficult to make a fit in which both legs 2 and both ends of strap 1 will hit a stud 6. Therefore, by using a joint tie-strap 10, the strap 10 is securely fastened to the studs, usually in at least 3 locations, as shown, and the legs 2 and strap 1 are fastened to the strap 10 at any position.

The outer binding strap 1 is similarly attached to the joint-tie strap 10 by self-tapping screws 4 through one of the plurality of holes in each end including the excess end 9 of binding strap 1. As can be seen, since binding strap 1 is a flexible, metallic strip, excess end 9 can be folded at any convenient length to adjust to the size of the water heater and distance from the wall in order to tightly affix the water heater against the supporting collar 3 resting on the supporting legs 2 thus solidly fixing the water heater to the closest wall structure.

In order to most securely fasten the water heater, a second binding strap system is placed at different vertical location around the water heater and is firmly attached to the same wall or a different wall which sits perpendicular to the wall section 7. Normally, one system is at or near the top of the tank and one at or near the bottom. The two systems solidly hold the water heater to the enclosure so that no independent movement of the water heater can take place in the event of an earthquake or other disaster which moves the wall itself. Thus, the water heater moves along with the wall and floor movement so that connecting water, gas or electric lines cannot be broken loose between the water heater and the enclosing structure.

It can be seen that the safety strap system provides an adjustable cradle for a water heater that becomes a rigid structure once fastened to the housing structure wall.

The adjustable cradle system allows installation of the safety strap system to water heaters already in place and operating, without disconnecting any water, gas or electric lines. The cradle collar is securely fastened between the wall of the housing structure and the water heater. The water heater is then fastened to the cradle collar with the adjustable strap 1. Once the strap is tight, the water heater will not move independently of the enclosing structure.

The safety strap or cradle system can be manufactured of any convenient material, the best being corrosive resistant steel.

While the safety strap system has been described with respect to a water heater tank, it is obvious that the system could be utilized for any tank system such as those that hold chemicals or other liquids, solids or gasses.

Having thus described the invention, it is requested that the invention be defined by the scope of the appended claims.

I claim:

1. A support system for a holding tank positioned near a wall comprising a rigid support collar, rigid support legs removably attached to said support collar at one end; each said support leg adapted to be attached at an angle to the wall at the other end, a flexible binding strap adapted to fit around said tank and further adapted to be attached to said wall.

2. The device of claim 1 further comprising a joint tie-strap adapted to be fixedly attached to the wall and to fixedly receive one end of the support legs and binding strap.

3. The device of claim 2 in which said support legs are removably attached to said support collar by swing-hinge hooks.

4. The device of claim 2 in which said joint tie-strap has alternating larger and smaller holes therein.

5. The device of claim 2 in which said joint tie-strap is attached to said wall by lag bolts.

6. The device of claim 2 in which said support collar and said binding strap are attached to said joint tie-strap by self-tapping screws.

7. The device of claim 1 in which said holding tank is a hot water heater.

8. A support system for a holding tank positioned near a wall comprising a rigid support collar, a flexible binding strap and a joint tie-strap, said rigid support collar adapted to fit partially around the circumference of said tank between said tank and said wall, rigid support legs removably attached to said support collar at one end; each said support leg adapted to be fixedly attached to said joint tie-strap at the other end forming an angle of between 30° and 60° to the wall, said flexible binding strap adapted to fit around said tank and further adapted to be attached to said joint tie-strap at both ends of said flexible binding strap.

9. The device of claim 8 comprising means to attach said support legs and said binding strap to said joint tie-strap.

10. The device of claim 9 in which said means comprises self-tapping screws.

11. The device of claim 8 in which said support legs are removably attached to said support collar by swing-hinge hooks.

12. The device of claim 8 in which said joint tie-strap has alternating larger and smaller holes therein.

13. The device of claim 8 in which said joint tie-strap is attached to said wall by lag bolts.

14. The device of claim 8 in which said holding tank is a hot water heater.

15. The device of claim 1 in which said support legs are set at an angle to the wall of between 30° to 60°.

* * * * *